US007251847B2

(12) United States Patent
Wells

(10) Patent No.: US 7,251,847 B2
(45) Date of Patent: Aug. 7, 2007

(54) CONTINUOUS WIRE SPRING MATTRESS OR SEATING PRODUCT AND METHOD OF MANUFACTURE

(75) Inventor: Thomas W. Wells, Joplin, MO (US)

(73) Assignee: L&P Property Management Company, South Gate, CA (US)

( * ) Notice: Subject to any disclaimer, the term of this patent is extended or adjusted under 35 U.S.C. 154(b) by 182 days.

(21) Appl. No.: 11/249,615

(22) Filed: Oct. 13, 2005

(65) Prior Publication Data

US 2007/0083996 A1 Apr. 19, 2007

(51) Int. Cl.
*A47C 27/04* (2006.01)
*A47C 27/07* (2006.01)
*B68G 7/00* (2006.01)

(52) U.S. Cl. ..... 5/716; 5/717; 5/739; 5/267; 29/91.1

(58) Field of Classification Search ..... 5/260, 5/267–269, 716, 717, 719, 721, 739; 267/96, 267/103–106; 29/91, 91.1
See application file for complete search history.

(56) References Cited

U.S. PATENT DOCUMENTS 1,372,362 A 3/1921 Giese
3,262,135 A 7/1966 Fasanella
3,660,876 A * 5/1972 Krier et al. ..... 29/91
3,732,586 A 5/1973 Frey ..... 5/345
3,911,511 A * 10/1975 Higgins et al. ..... 5/255
4,492,298 A 1/1985 Zapletal et al. ..... 198/409
4,625,349 A * 12/1986 Higgins ..... 5/248
4,766,624 A * 8/1988 Yates et al. ..... 5/248
4,942,636 A 7/1990 Scott et al. ..... 5/475
4,972,536 A 11/1990 Scott ..... 5/464
5,649,332 A * 7/1997 Wells et al. ..... 5/727
5,724,686 A * 3/1998 Neal ..... 5/717
2004/0237204 A1 12/2004 Antinori
2004/0261186 A1 12/2004 Gladney

* cited by examiner

*Primary Examiner*—Michael Trettel
(74) *Attorney, Agent, or Firm*—Wood, Herron & Evans, LLP

(57) ABSTRACT

A mattress or seating spring core assembly and method of manufacture which comprises interconnected rows of coil springs wherein each row terminates in a cut wire end which is bent inwardly into one of the end coils and in which the spring core assembly is surrounded on all sides by foam panels and is devoid of any border rods.

7 Claims, 5 Drawing Sheets

CONTINUOUS WIRE SPRING MATTRESS OR SEATING PRODUCT AND METHOD OF MANUFACTURE

BACKGROUND OF THE INVENTION

This invention relates to seating and bedding products and, more particularly, to such products which include spring assemblies containing rows of springs made from a single continuous wire, as well as to methods of manufacturing such products.

At the present time, many different seating and bedding products contain rows of interconnected springs made from a single strand of wire. Conventionally, such products are manufactured by forming a strand of wire into a continuous stream of springs which must then be cut-to-length and those cut-to-length strands or rows of coils then assembled into a spring assembly, usually by interconnecting the strands or rows by means of helical lacing wires. When those strands or strings are cut-to-length, the ends of those cut-to-length strings are then conventionally formed into a target area for the application of a border rod to be clipped around the periphery of the spring assembly. This clipped border rod then offers perimeter edge support, spring assembly unit sizing assistance, and protects the mattress construction and consumer from coming in contact with cut coil ends. The border rods also function to prevent entanglement of spring assemblies with one another during production and packaging of the spring assemblies or shipment to seating or mattress manufacturers. But for the reasons set forth hereinabove, those border rods are maintained on such continuous wire spring assemblies even when such assemblies are encased in foam side panels as well as top and bottom panels. There would be a substantial cost savings if the border rods could be eliminated from such spring assemblies, but for the reasons set forth hereinabove, that has not, to this date, been done.

It has therefore been an objective of this invention to provide a continuous wire spring assembly which eliminates the border rod conventionally used in such assemblies while still providing an assembly which has perimeter edge support, does not require sizing assistance and which protects the mattress manufacturer and consumer from coming into contact with cut coil ends.

SUMMARY OF THE INVENTION

The invention of this application comprises a spring assembly manufactured from multiple continuous lengths of wire containing multiple interconnected springs and with the rows being interconnected so as to provide a spring assembly which does not include a border rod surrounding such assembly. In the manufacture of the spring assembly, the lengths of continuous spring strands of coil springs are cut and simultaneously formed at the end so as to present a cut end which is bent backwardly and inwardly into the last coil in the row. This assembly is then encased within side panels of foam, preferably a urethane or latex or other resilient foam side panel which surrounds the spring assembly so as to provide edge support and sizing of the spring assembly and protection of the ends of the spring assembly from coming into contact with a workman assembling the spring assembly into a seating or mattress product. The top and bottom surfaces of the spring assembly and its foam panel edge support may be covered by foam top and bottom surface panels.

The foam encased spring assembly made in this manner eliminates border rods which have heretofore always been required in such assemblies, thereby affords a cost savings in the resulting product without sacrificing edge support, unit sizing or product safety.

These and other objects of this invention will become more readily apparent from the following description of the drawings in which.

Figure 1:
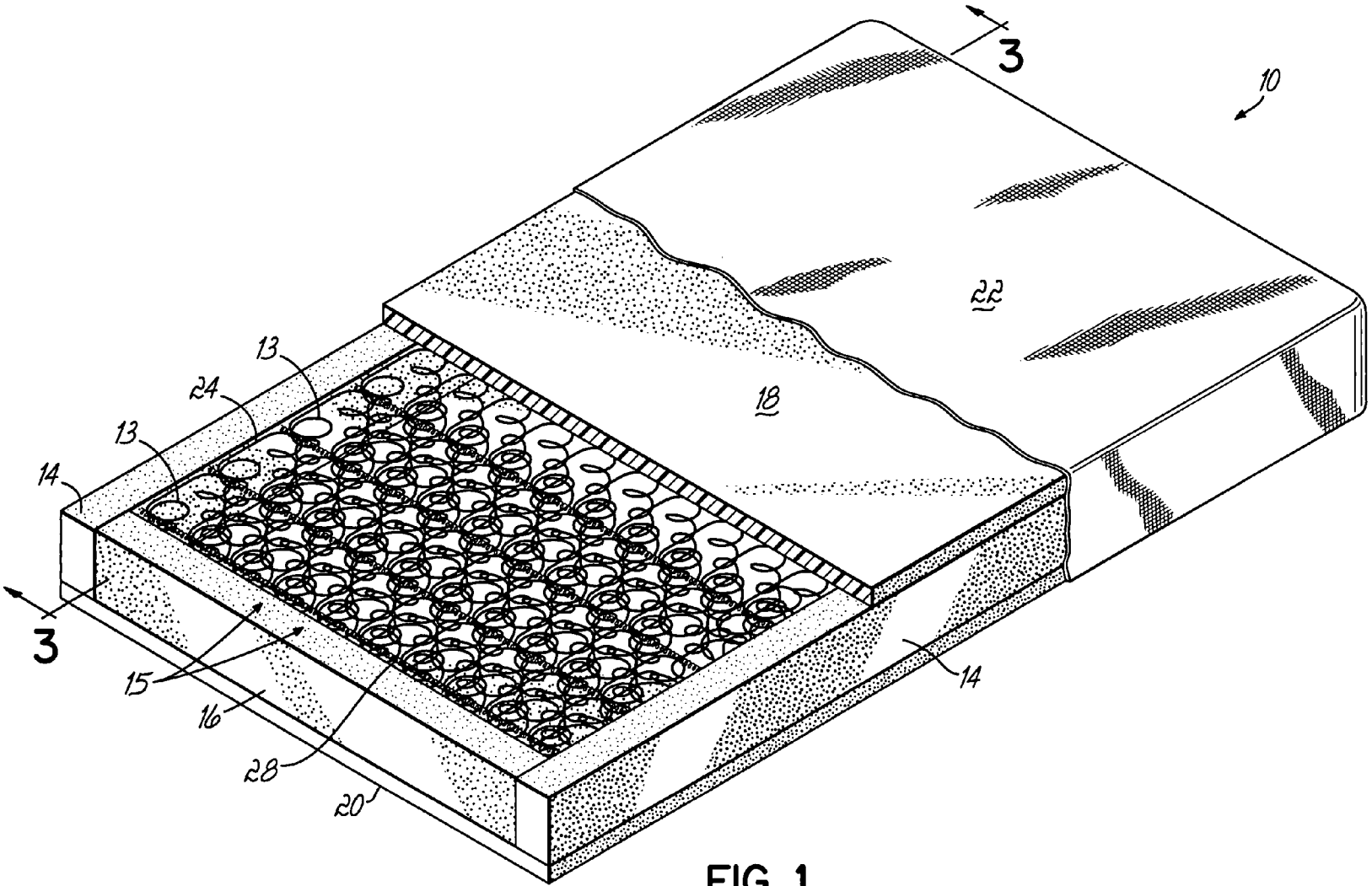
FIG. 1 is a perspective view of a mattress, including a spring assembly made in accordance with the practice of this invention.
Figure 2:
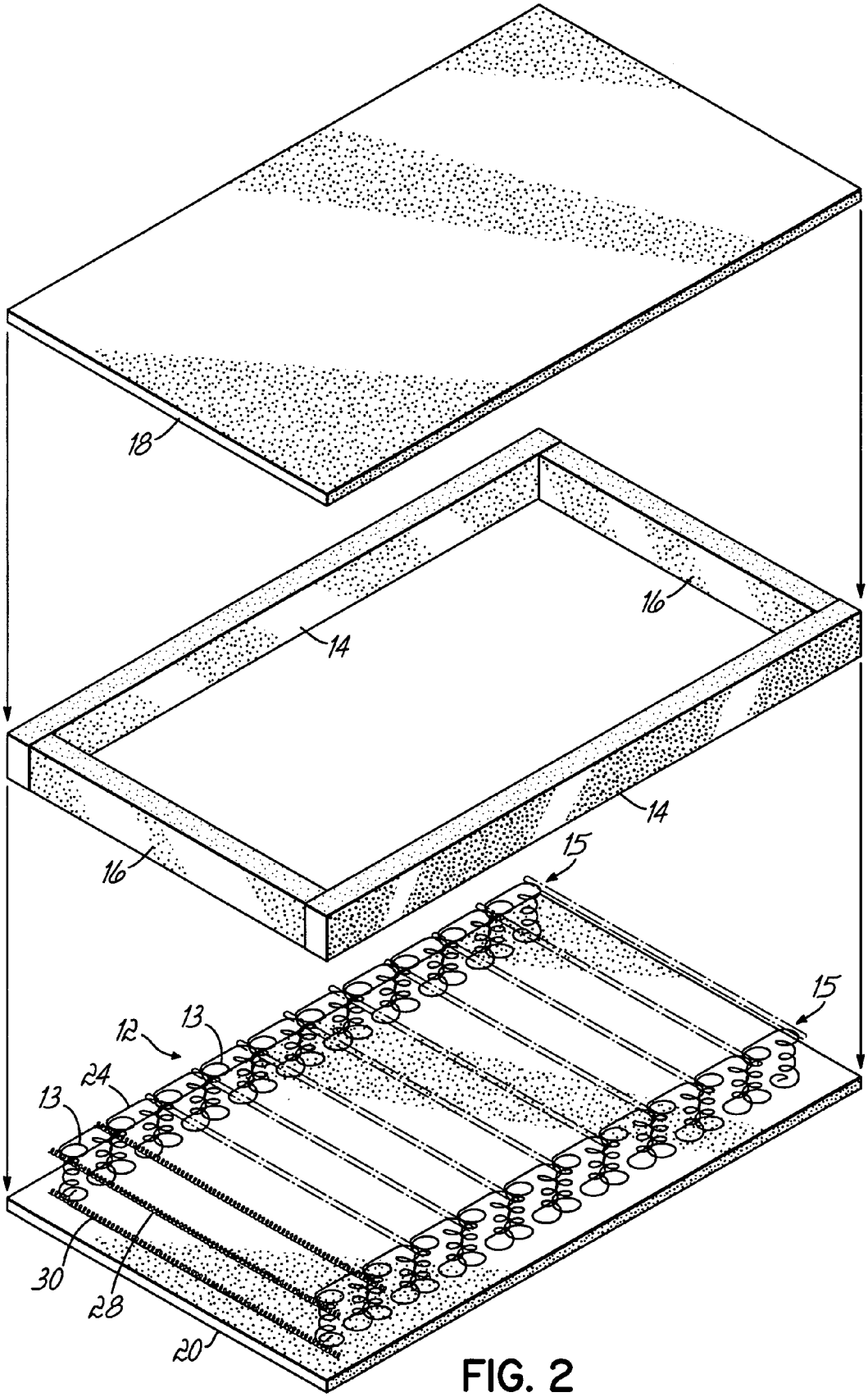
FIG. 2 is an exploded perspective view of the spring assembly of FIG. 1.
Figure 3:
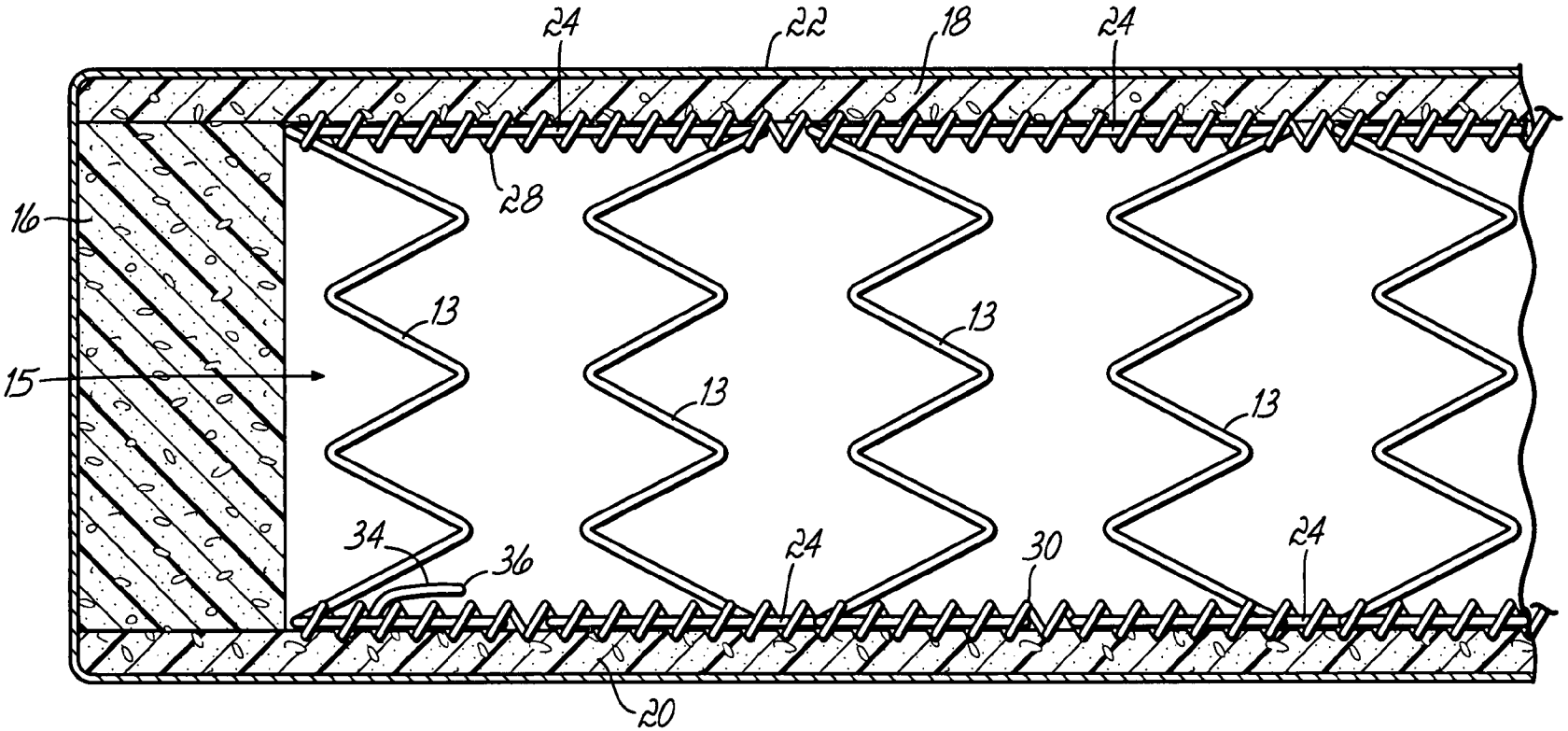
FIG. 3 is a cross section through a portion of a spring assembly of FIG. 1.

With reference first to FIG. 1, there is illustrated a mattress 10 which comprises a spring core assembly 12 encased within foam side and end panels 14 and 16, respectively. As illustrated in FIGS. 1 and 2, the spring core assembly 12, as well as the side panels 14 and 16, are covered by top and bottom foam cover panels 18 and 20, respectively. This complete assembly of foam encased spring core assembly 12, side and end panels 14, 16, and top and bottom covers 18 and 20 are encased within an upholstered covering 22 in order to complete the mattress 10.

While the invention is illustrated herein as incorporated into a mattress, it could just as well, and the invention of this application is equally applicable to seating products.

Figure 5:
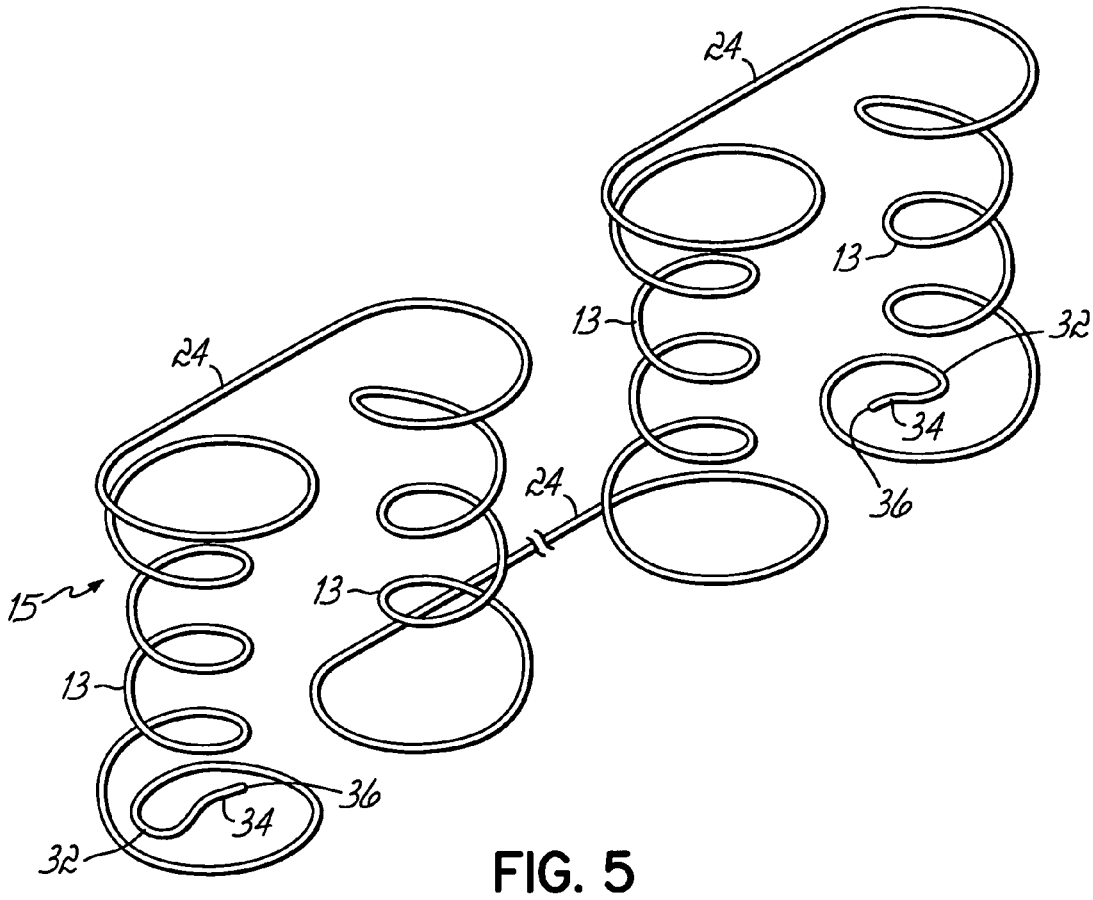
FIG. 5 is an enlarged perspective view, partially broken away, of a string or strand of coils utilized in the spring assembly of FIG. 1.

The spring core assembly 12 is manufactured from individual strands or rows or strings 15 of interconnected coil springs 13 (See FIG. 5), each strand 15 of which contains multiple coil springs 13 interconnected by an interconnecting section 24 of the strand of wire from which the strand or string of coils is manufactured. In order to manufacture a spring core assembly 12, the practice is to manufacture one long continuous string of coil springs and to cut that long continuous string into strands or rows 15 of a particular length depending upon the dimensions of the core assembly to be created from the individual strands or strings 15 of coils.

Figure 4:
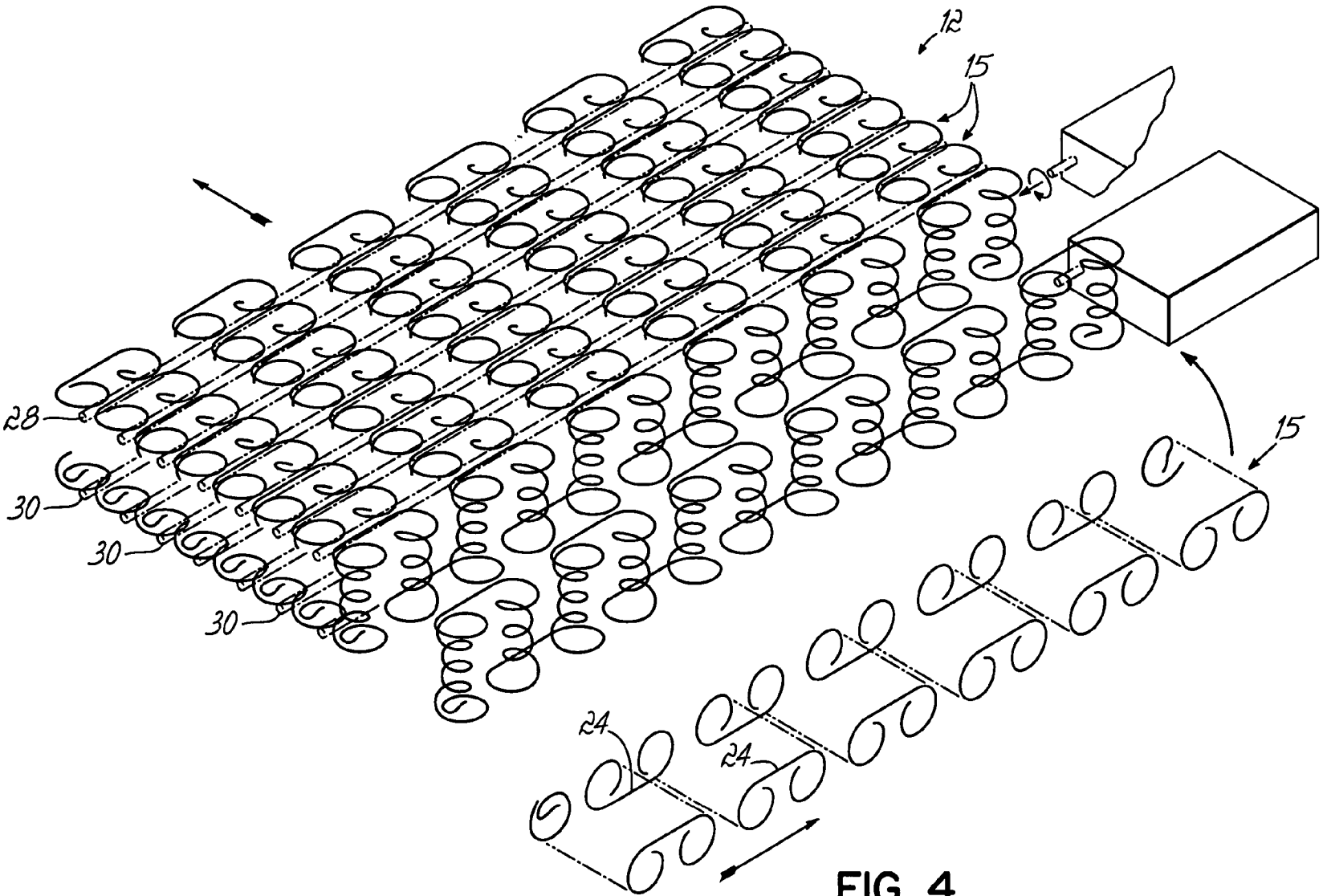
FIG. 4 is a diagrammatic illustration of a method of manufacturing a continuous wire spring assembly made in accordance with the practice of this invention.

As illustrated diagrammatically in FIG. 4, the individual strings of coil springs, after having been cut-to-length, are then placed in juxtaposition to a previously cut-to-length string or row 15 and the two strands or strings 15 interconnected by top and bottom lacing wires 28, 30, respectively. After the appropriate number of strings of coil springs have been laced together to create the appropriately dimensioned spring core assembly 12, that assembly is moved off the assembly line and the process repeated to create the next following spring assembly 12. It is also the practice in the industry, when creating spring core assemblies to complete the assembly by encasing the spring core assembly within top and bottom border rods which are conventionally secured to the top and bottom edgemost coils of the assembly by sheet metal clips. Such border rods have conventionally been secured to the spring core assembly made from such continuous wires in order to give the resulting spring assembly some perimeter edge support, as well as to size the units which generally are made from light gauge wire which has very little stability in the absence of the border rods. But as may be seen in the drawings of this application, the spring core 12 of the assembly of this invention omits the border rods which have heretofore been characteristic of spring core assemblies made from continuous strands of springs.

The spring core assembly 12 illustrated in the drawings of this application are so-called "Multilastic" or "Superlastic"

spring assemblies, so-called because of the shape of the wire which connects adjacent coils in a string or row of coil springs. More complete and detailed description of spring core assemblies and the method and manufacture of those coil springs made from these so-called "Multilastic" or "Superlastic" coil spring assemblies may be found in the assignee's own earlier U.S. Pat. Nos. 4,972,536 and 4,942,636, the disclosures of which are hereby incorporated by reference.

Another style of spring core assembly which may be used in the practice of this invention are so-called "Mira-Coil" coil spring assemblies wherein the adjacent coil springs in a row of coil spring are interconnected by generally Z-shaped connectors. One patent assigned to the assignee of this application which discloses such a spring core assembly and a method of manufacturing it is the assignee's own U.S. Pat. No. 4,492,298, the disclosure of which is also incorporated herein by reference.

Irrespective of what style or configuration of coil springs is used in the practice of this invention to create the rows of continuous springs, the ends of each string or row of coils, when cut-to-length, is shaped so as to place the cut end of the row of springs interiorly of the endmost coil. To that end, either during or immediately after the cutting-to-length of the row of coil springs, the cut end is bent inwardly toward the axis of the coil spring as indicated at 32 in FIG. 5 and then inwardly in an axial direction as indicated at 34 to further place the cut end 36 of the row of coil springs well within the interior of the endmost coil spring 13 of a row of coil springs.

The assembled spring assembly 12 wherein the rows of coil springs are all interconnected at the top and bottom by lacing wires 28 and 30 are encased within and surrounded by the side panels 14 and end panels 16 of polymeric/copolymeric plastic foam material, usually a urethane or latex foam. These side panels are of substantial width, usually three or four inches in width and of the same height as the axial length of the coil springs of the coil spring assembly. The side panels, as well as the spring core assembly, are preferably then encased within the top and bottom panels 18 and 20 of the same or a different polymeric/copolymeric plastic foam material which covers the top and bottom surfaces, respectively, of the side panels, as well as the complete top and bottom surfaces of the spring core assembly.

While I have described only a single preferred embodiment of the invention of this application, persons skilled in this art will appreciate that the invention is applicable to bedding or seating products utilizing different configurations of continuous rows of coil springs in which all of the springs of the row are interconnected and made from a single strand of wire. Such persons will also appreciate that the rows of springs of the assembly may be interconnected by either longitudinally or transversely extending lacing wires or alternatively, interconnected by other conventional connectors. I therefore do not intend to be limited except by the scope of the following appended claims.

I claim:

1. A method of manufacturing a bedding mattress having a foam: encased spring assembly, which method comprises:

forming a wire into a continuous row of interconnected coil springs;

cutting said continuous row of coil springs into multiple continuous lengths of coil springs, each continuous length of coil springs containing multiple coil springs;

bending the cut ends of said lengths of coil springs inwardly into the interior of an endmost coil in each length of coil springs;

assembling multiple lengths of coil springs into a spring core assembly having adjacent continuous lengths of coil springs interconnected by helical lacing wires;

said spring core assembly being devoid of border rods surrounding said spring core assembly; and encasing the sides of said spring core assembly within side border panels made from a foam material.

2. A method of manufacturing a foam encased spring assembly which comprises:

forming a wire into a continuous row of interconnected coil springs;

cutting said continuous row of coil springs into multiple continuous lengths of coil springs, each continuous length of coil springs containing multiple coil springs;

bending the cut ends of said lengths of coil springs inwardly into the interior of an endmost coil in each length of coil springs;

assembling multiple lengths of coil springs into a spring core assembly having adjacent continuous lengths of coil springs interconnected by helical lacing wires;

said spring core assembly being devoid of border rods surrounding said spring core assembly; and encasing the sides of said spring core assembly within side border panels of a foam material.

3. The method of claim 2 which further comprises:

placing a top pad of foam material over the top and over the bottom of said spring assembly and said foam side border panels.

4. A bedding mattress having a spring core assembly comprising:

a plurality of rows of interconnected coil springs, each of said rows being formed from a single continuous wire;

each of said rows of interconnected coil springs terminating in a cut end portion of wire, each of said cut end portions of wire being bent inwardly into one endmost coil spring of a row of interconnected coil springs;

connectors securing adjacent rows of interconnected coil springs together to form a spring core assembly;

said spring core assembly being devoid of border rods; and foam border panels encasing all sides of said spring assembly; and an upholstered fabric encasing said spring core assembly and said border panels.

5. The spring assembly of claim 4 which further comprises foam pads covering top and bottom surfaces of said spring assembly and said foam border panels.

6. A spring core assembly comprising:

a plurality of rows of interconnected coil springs, each of said rows being formed from a single continuous wire;

each of said rows of interconnected coil springs terminating in a cut end portion of wire, each of said cut end portions of wire being bent inwardly into one endmost coil spring of a row of interconnected coil springs;

connectors securing adjacent rows of interconnected coil springs together to form a spring core assembly;

said spring core assembly being devoid of border rods; and a foam border encasing all sides of said spring assembly.

7. The spring core assembly of claim 6 which further comprises foam pads covering top and bottom surfaces of said spring assembly and said foam border.

* * * * *